US005443369A

United States Patent [19]

Martin et al.

[11] Patent Number: 5,443,369

[45] Date of Patent: Aug. 22, 1995

[54] SELF-CONTAINED INSTRUMENT AND SEAL AIR SYSTEM FOR A CENTRIFUGAL COMPRESSOR

[75] Inventors: Daniel T. Martin, Clemmons; Devin D. Biehler, Mocksville, both of N.C.

[73] Assignee: Ingersoll-Rand Company, Woodcliff Lake, N.J.

[21] Appl. No.: 74,078

[22] Filed: Jun. 9, 1993

[51] Int. Cl.[6] ..... F04B 23/00

[52] U.S. Cl. ..... 417/53; 417/313; 417/364

[58] Field of Search ..... 417/364, 299, 302, 308, 417/244, 253, 53, 313; 137/115, 116, 487.5; 95/117; 96/108, 118

[56] References Cited

U.S. PATENT DOCUMENTS

| | | | |
|---|---|---|---|
| 3,153,508 | 10/1964 | Sawyer | 717/243 |
| 4,311,439 | 1/1982 | Stofen | 717/313 |
| 4,705,067 | 11/1987 | Coffee | 137/487.5 |
| 5,284,202 | 2/1994 | Dickey et al. | 165/1 |
| 5,306,116 | 7/1994 | Gunn et al. | 415/25 |
| 5,310,020 | 5/1994 | Martin et al. | 184/6.3 |
| 5,348,450 | 9/1994 | Martin et al. | 717/299 |
| 5,362,207 | 11/1994 | Martin et al. | 717/243 |
| 5,370,152 | 12/1994 | Carey et al. | 137/487.5 |
| 5,386,873 | 2/1995 | Harden, III et al. | 165/47 |

*Primary Examiner*—Richard A. Bertsch
*Assistant Examiner*—Peter Koryinyk
*Attorney, Agent, or Firm*—Victor M. Genco, Jr.

[57] ABSTRACT

A self-contained seal air and instrument air system for a compressor includes a pneumatically controllable inlet valve and a pneumatically controllable valve means for depressurizing the compressor. An electronic controller directs compressor operation. A receiver tank is provided which includes an inlet through which compressed air enters and an outlet port. A means is provided for separating the compressed air flowing from the receiver into a first path which provides a first source of seal air to seals of a rotating shaft of the compressor, and a second path which provides instrument air. A means is provided for separating the compressed air flowing in the instrument air path into a first path which provides actuating air to the inlet valve and the valve means for depressurizing the compressor, and a second path which provides a source of signal air. First and second current-to-pressure converters are flow connected in the signal air path and are disposed in electronic signal receiving relation to the electronic controller. A second source of seal air is provided from a tap port disposed at a predetermined location on the compressor discharge.

4 Claims, 4 Drawing Sheets

SELF-CONTAINED INSTRUMENT AND SEAL AIR SYSTEM FOR A CENTRIFUGAL COMPRESSOR

BACKGROUND OF THE INVENTION

This invention generally relates to compressors, and more particularly to a self-contained instrument and seal air system for a centrifugal compressor.

Centrifugal compressor systems which include pneumatically controlled valves and components require high quality instrument air to actuate these pneumatic compressor elements. Centrifugal compressors also require a source of seal air to prevent oil migration across compressor shaft face seals. When a stationary centrifugal compressor package is installed within a manufacturing facility, typically, the instrument air and the seal air is provided from a source external to the centrifugal compressor package, such as by the manufacturing facility itself. However, in truly portable compressor applications at remote locations, facility or plant supplied instrument air typically is not available for use by the portable compressor. Additionally, if such plant or facility supplied instrument air is available, often this externally supplied instrument air contains particulates, debris, and other foreign matter which clogs or otherwise damages the very sensitive pneumatically controlled components.

The foregoing illustrates limitations known to exist in present portable compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a self-contained seal air and instrument air system which includes a compressor having an inlet, a discharge, and at least one rotating shaft which has disposed thereon at least one set of seals. An engine provides a motive force to the compressor. A controllable inlet valve is flow connected with the compressor inlet. An electronic controller directs compressor operation. A receiver tank includes an inlet through which compressed air enters and an outlet port. A filter is flow connected with the receiver tank outlet port. A means is provided for separating the compressed air flowing from the receiver tank into a first path which provides a first source of seal air to the seals of the rotating shaft of the compressor, and a second path which provides instrument air. A controllable valve means is provided for depressurizing the compressed air system. A means is provided for filtering and drying the compressed air entering the instrument air path. A means is provided for separating the compressed air flowing in the instrument air path into a first path which provides actuating air to the controllable inlet valve and the controllable depressurizing valve, and a second path which provides a first source of signal air. A pressure regulator is flow connected with the actuator air path. A filter regulator filters the air entering the signal air path and regulates the pressure in the signal air path to a predetermined pressure. First and second current-to-pressure converters are flow connected in the signal air path and are disposed in electronic signal receiving relation to the electronic controller. The first current-to-pressure converter is disposed in pneumatic signal transmitting relation to the controllable inlet valve. The second current-to-pressure converter is disposed in pneumatic signal transmitting relation to the controllable depressurizing valve means. A pressure regulator is flow connected with the seal air path. A second source of seal air is provided from a tap port disposed at a predetermined location on the compressor discharge.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 2:
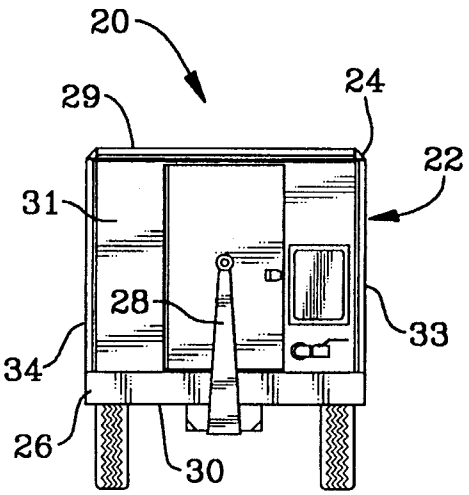
FIG. 2 is a front view of the compressor illustrated in FIG. 1.
Figure 1:
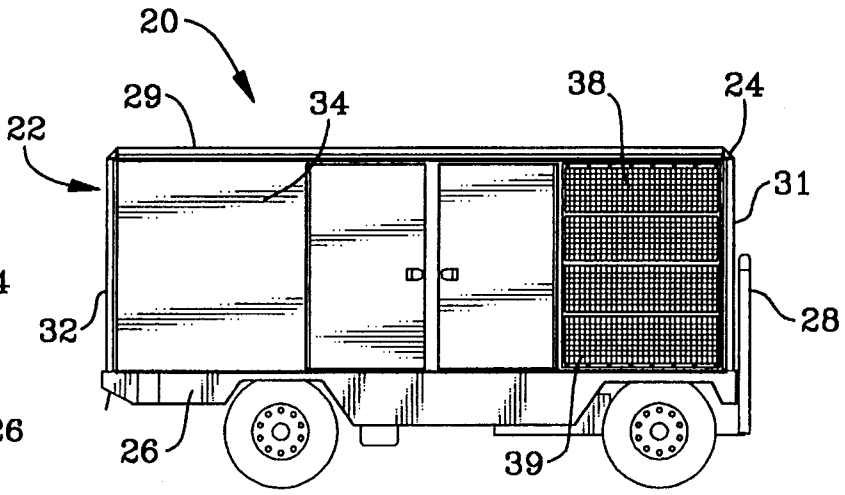
FIG. 1 is a side view of a portable, diesel-driven centrifugal compressor which includes the self-contained instrument and seal air system of the present invention.
Figure 3:
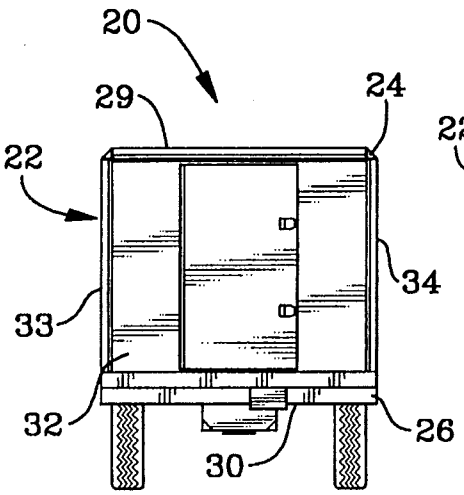
FIG. 3 is a rear view of the compressor illustrated in FIG. 1.

Referring now to FIGS. 1–3, portable, diesel-driven centrifugal compressor is generally illustrated at 20. The apparatus 20 includes an upper compressor package portion 22 which is enclosed by a housing 24, and a full-chassis and running gear portion 26 which includes a tow bar assembly 28. The portable compressor 20 has a top portion 29, a bottom portion 30, a front portion 31, a rear portion 32, a left portion 33, and a right portion 34. An engine exhaust pipe outlet (not shown) and a cooling air exhaust area (not shown) are located at the rear of the top portion 29. A large ambient air intake 38 is located on each the left side and the right side of the housing. The ambient air intakes 38 are each covered by a protective grill 39 which prevents foreign debris from entering the interior of the compressor housing 24 during operation.

Figure 4:
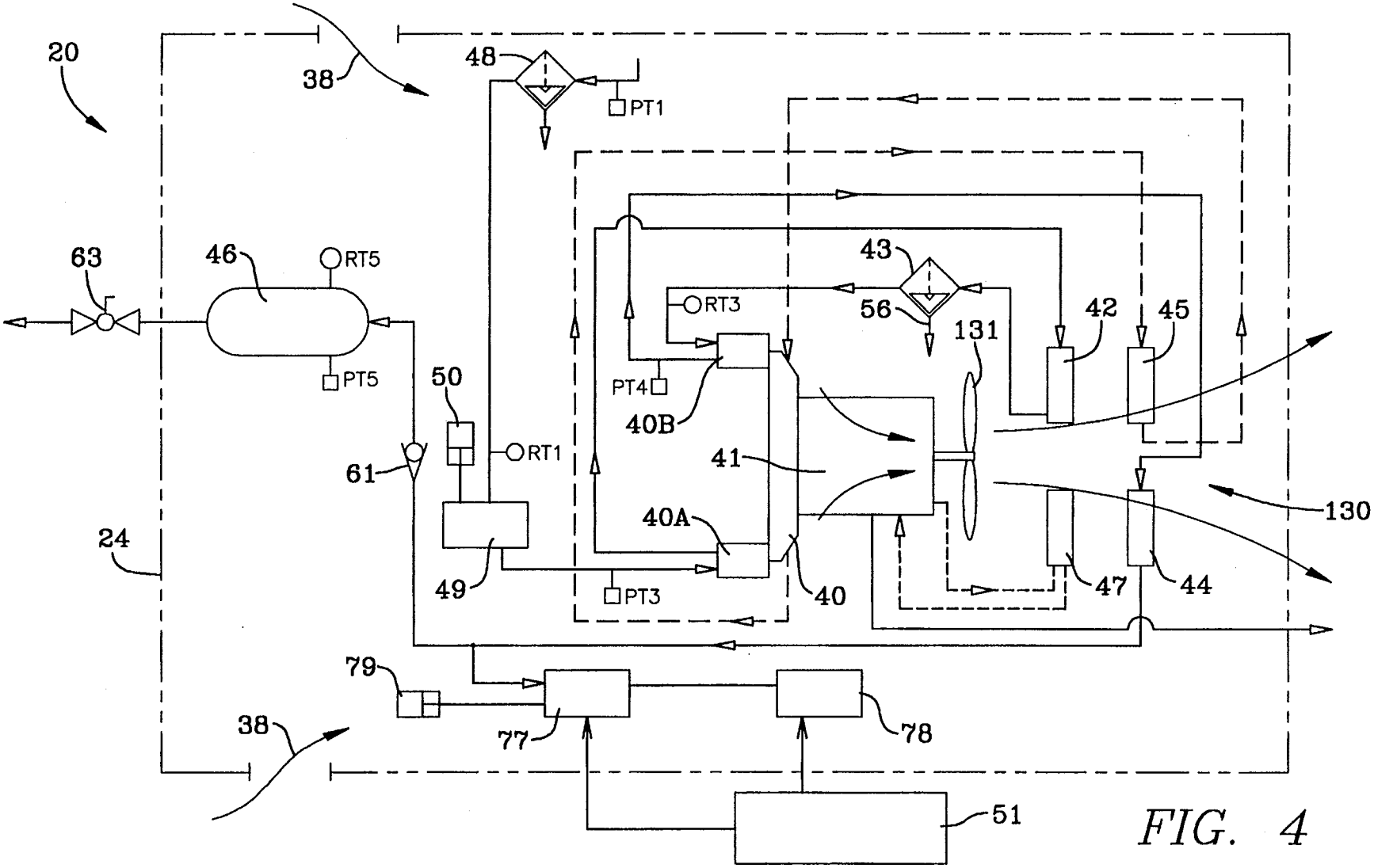
FIG. 4 is a functional schematic of a compressed air system according to the present invention.

FIG. 4 is a functional schematic of a compressed air system of the compressor 20 having the following major system components: a two stage centrifugal compressor or airend 40, having a first stage 40A, a second stage 40B, and a casing (not shown); a prime mover 41, such as a diesel engine having a casing (not shown); an intercooler 42; a water separator 43; an aftercooler 44; an oil cooler 45; a receiver tank 46; and an engine radiator 47. These major system components will be described in further detail hereinafter. Although a two-stage centrifugal compressor or airend 40 is described herein, it is anticipated that the teachings of the present invention apply equally to compressed air systems having one stage or more than two stages, as well.

The two stage centrifugal compressor 40 is driven by the diesel engine 41. Referring to FIG. 4, airend intake air is drawn from within the housing 24 and flows through an intake filter apparatus 48. The filtered intake air then flows through an inlet duct (not shown) to an inlet control valve 49, which in the preferred embodiment is a butterfly type valve operated by a pneumatically controlled positioner/actuator 50. The inlet control valve 49 is directly mounted on the airend first stage head, as is well known in the art. The inlet control valve 49 is used for pressure and capacity control and is dynamically controlled by a microprocessor based electronic controller 51 which is illustrated by the block diagram of FIG. 6.

The compressor 20 includes instrumentation fluidly disposed in the intake air path, upstream of the first stage of the airend, namely, a pressure sensor PT1 fluidly disposed upstream of the air intake filters 48, sensor PT1 sensing ambient barometric pressure; a temperature sensor RT1 fluidly disposed upstream of the inlet control valve 49, sensor RT1 sensing stage 1 inlet temperature; and a pressure sensor PT3 which senses stage 1 inlet vacuum.

Air entering the first stage 40A of the airend 40 is compressed to an intermediate predetermined pressure of approximately 35 PSIG. The air exits the first stage and flows through an interstage duct (not shown) to the intercooler 42 for cooling prior to entering stage two for final compression. Cooled and saturated interstage air then leaves the intercooler 42 and flows through the water separator 43 to the airend 40 for second stage compression. Instrumentation present within the interstage air path includes a temperature sensor RT3 which measures second stage inlet temperature.

Interstage air is compressed by the second stage 40B to a pressure equal to 3–4 PSI above a predetermined receiver tank pressure. The second stage compressed air exits the second stage 40B and flows through the afterstage discharge duct (not shown) to the aftercooler 44 for final cooling, and through a spring-loaded wafer-style check valve 61 to the inlet of the receiver tank 46. Compressed air is discharged out of the compressed air system through a service valve 63. Instrumentation which is present within the afterstage air path includes a pressure sensor PT4 which senses stage 2 outlet pressure, a pressure sensor PT5 which senses receiver tank pressure, and a temperature sensor RT5 which senses receiver tank temperature.

Figure 5:
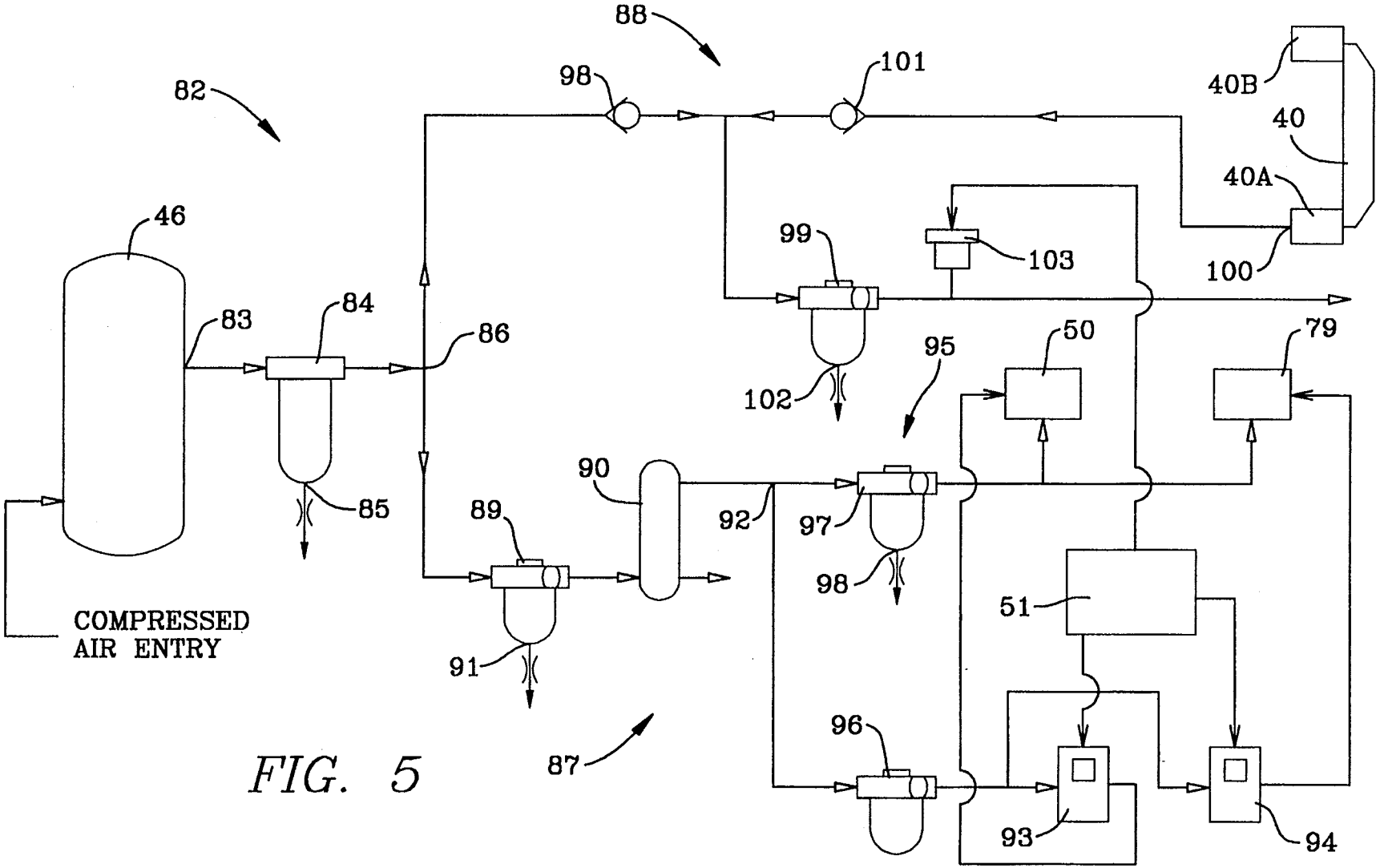
FIG. 5 is a functional schematic of a self-contained instrument air and seal air system for a centrifugal compressor according to the present invention.

As best seen by reference to FIG. 5, the compressor 20 includes a self-contained instrument and seal air system which is generally indicated at 82. The self-contained instrument and seal air system 82 delivers clean, dry, regulated air to the inlet control valve position/actuator 50 and a blowoff valve positioner/actuator 79, and to airend seals (not shown) at a predetermined regulated pressure. As used herein, the term seal air shall mean a source of low pressure, clean compressed air that is delivered to a high speed seal assembly (not shown) which is disposed on the main rotating shafts (not shown) of the airend 40 to provide a buffer air pressure between two sets of ring face seals (not shown) to prevent shaft lubricating oil from migrating into the compressed air stream.

The self-contained instrument and seal air system 82 is flow connected to, and is supplied with, compressed air from the receiver tank 46. Compressed air flowing from the receiver tank 46 exits the receiver tank at an outlet port location 83 which is disposed in a substantially higher location than the location of the compressed air entry into the receiver tank. The compressed air flowing from the receiver tank 46 is filtered by a primary air filter 84 which is mounted on the receiver tank 46. In the preferred embodiment, the primary air filter 84 includes a coalescing-type element which removes approximately 93% of all particulates, liquid or debris, greater than 1 micron in size. Any water which is removed at the primary air filter 84 is drained through a constant bleed orifice drain fitting 85 which is located at a bottom portion of the primary air filter 84. At a predetermined fluid point 86, which is located downstream of the primary air filter 84, the filtered compressed air flowing from the receiver tank 46 is separately directed to an instrument air branch 87 and a seal air branch 88.

The compressed air which enters the instrument air branch 87 not only must be filtered, but also must be very dry, therefore, a secondary instrument air filter 89 is flow connected upstream of a dryer unit 90. In the preferred embodiment, the secondary instrument air filter 89 is a coalescing type filter, and the dryer unit 90 is a membrane type dryer. The secondary instrument air filter 89 removes substantially all of the solid and liquid particulates greater than 0.1 micron in diameter. Any droplets of liquid which are removed by the secondary instrument air filter 89 are discharged through an orifice drain fitting 91 which is located at a bottom portion of the secondary instrument air filter.

The dryer 90 removes water vapor, as opposed to water droplets, from the instrument air branch 87, and therefore, the dryer 90 must be close coupled in fluid flowing relation to the secondary instrument air filter 89 to prevent any water from condensing in the compressed airstream intermediate the secondary instrument air filter 89 and the dryer 90. As previously stated, a membrane type dryer 90 is used in lieu of other type dryers, such as a desiccant type dryer. In this regard, testing has demonstrated that desiccant type dryers are not efficient in the present system at the high temperatures which are present within the instrument air branch 87, and further, carryover (particulates) originating from a desiccant dryer clog instrumentation downstream of the dryer.

At a predetermined fluid point 92, which is located downstream of the dryer 90, the filtered, dried compressed air is separately directed to a signal air branch including first and second I/P transducers 93,94 (current-to-pressure converters), and to an actuator air branch 95. Air for the first and second I/P transducers 93,94 first flows through a filter/regulator unit 96 which reduces the pressure of the compressed air to 25 PSIG. The I/P transducers are disposed in electronic signal receiving relation to the electronic controller 51 which is operable to supply the I/P transducer with a current signal ranging between 4 and 20 milliamps. The first and second I/P transducers are disposed in pneumatic signal transmitting relation to the inlet control valve pneumatic positioner/actuator 50 and the blowoff valve pneumatic positioner/actuator 79, respectively, to provide these positioner/actuators with a 3–15 PSIG pneumatic signal which is linear with respect to the 4–20 milliamp current signal.

As best seen by reference to FIG. 5, compressed air for the actuator air branch 95 flows from the fluid point 92 through a pressure regulator 97 which reduces the pressure of the compressed air to 80 PSIG. The pressure regulator 97 is fitted with a drain cock 98 for occasional draining. The 80 PSIG compressed air is then supplied to the inlet control valve pneumatic positioner/actuator 50 and the blowoff valve pneumatic positioner/actuator 79 to control operation of the inlet control valve 49 and the blowoff valve 77 in response to the 3–15 PSIG signal air supplied from the I/P transducers 93,94.

As illustrated by FIG. 5, there are two sources of compressed air for the seal air branch 88. When the compressor 20 is loaded, the primary source of seal air flows from the receiver tank 46, through a check valve 98, and through a seal air pressure regulator 99. The seal air pressure regulator 99 reduces the pressure of the compressed air to 7 PSIG. An orifice drain fitting 102 is installed at a bottom portion of the seal air pressure regulator 99 for discharging any collected water in the pressure regulator. When the compressor 20 is not loaded, a second source of seal air is provided from a tap port 100 which is disposed in the outlet head of the first compressor stage 40A. This tap port 100 bleeds air from the first stage outlet at approximately 4–5 PSIG. The 4–5 PSIG bleed air flows through a check valve 101 to the pressure regulator 99. Therefore, if the receiver tank pressure is equal to or greater than the pressure in the first stage tap line, the receiver tank 46 will supply the pressure to the seal air branch. However, if the receiver tank pressure is below the tap pressure from the first stage outlet, the first stage outlet will supply the seal air pressure. Thereafter, the low pressure seal air is then supplied to the seal air manifold (not shown) which is mounted on the airend 40.

A normally open pressure switch 103, which is disposed in electronic communication with the electronic controller 51, is mounted in pressure sensing relation with the seal air pressure regulator 99. The pressure switch 103 provides automatic shutdown of the compressor 20 in such instances when the pressure of the compressed air flowing from the pressure regulator 99 is below a predetermined magnitude, which in the preferred embodiment is 2.5 PSIG.

Figure 6:
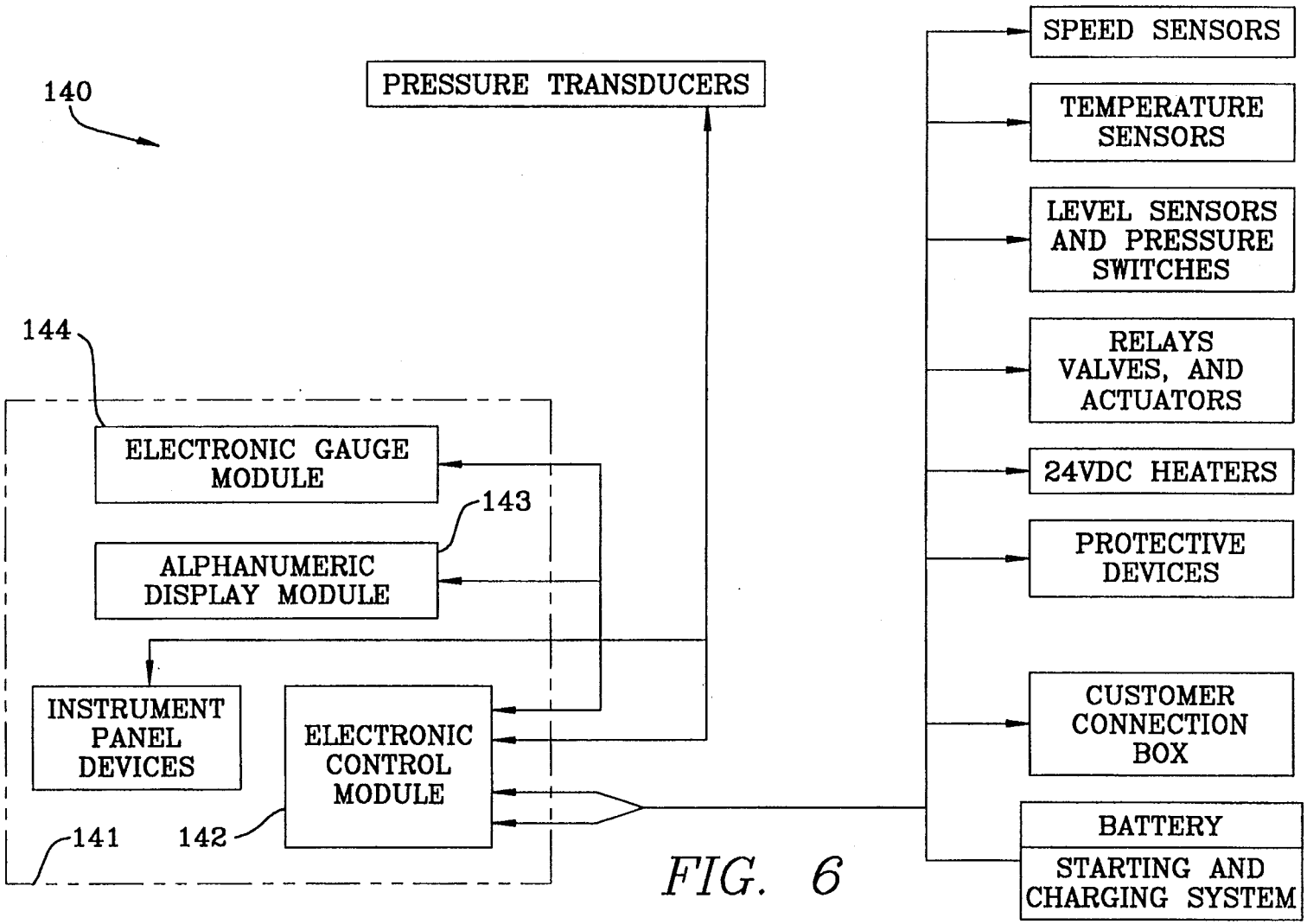
FIG. 6 is a block diagram of an electronic control system according to the present invention.

FIG. 6 provides a functional block diagram of a compressor electronic control system 140 which includes the microprocessor-based electronic controller 51 which provides complete control of the compressor 20. The electronic control system 140 includes an electronic control module 142, an alphanumeric display module 143, and an electronic gauge module 144. The electronic control module 142 includes the electronic controller 51 and various primary control switches and indicator lamps.

The alphanumeric display module 143 includes a message display and a digital display to provide a user with diagnostic information, operational status messages, and the name of a measured parameter being displayed in the digital display.

The electronic gauge module 144 includes a plurality of lighted liquid crystal display (LCD) bar graph units which may display such information as the amount of fuel in tanks, engine oil pressure, engine coolant temperature, and service air temperature.

The electronic controller 51 provides a full complement of diagnostics and automatic shutdowns to protect the compressor 20 from damage when in need of maintenance or in the event of malfunction. For example, if the pressure measured at pressure sensor 103 is below a predetermined value the compressor 20 is shut down by the electronic controller 51. When the electronic controller detects an operating parameter at a dangerously high or low level or if a critical sensor is malfunctioning, the machine will be automatically unloaded and stopped with the cause of the shutdown shown on message display.

While this invention has been illustrated and described in accordance with a preferred embodiment, it is recognized that variations and changes may be made therein without departing from the invention as set forth in the following claims.

Having described the invention, what is claimed is:

1. A self-contained seal air and instrument air system comprising:

a compressor having an inlet, a discharge, and at least one rotating shaft which has disposed thereon at least one set of seals;

engine means for providing a motive force to the compressor;

a controllable inlet valve flow connected with the compressor inlet;

electronic controller means for directing compressor operation;

a receiver tank having an inlet through which compressed air enters and an outlet port;

means for filtering the compressed air flowing from the receiver tank outlet port;

means for separating the compressed air flowing from the receiver tank into a first path which provides a first source of seal air to the seals of the rotating shaft of the compressor, and a second path which provides instrument air;

controllable valve for depressurizing the compressed air system;

means for filtering and drying the compressed air entering the instrument air path;

means for separating the compressed air flowing in the instrument air path into a first path which provides actuating air to the controllable inlet valve and the controllable depressurizing valve, and a second path which provides a source of signal air;

pressure regulator means flow connected with the actuator air path;

filter regulator means for filtering the air entering the signal air path and for regulating the pressure in the signal air path to a predetermined pressure;

first and second current-to-pressure converter means flow connected in the signal air path and disposed in electronic signal receiving relation to the electronic controller, and wherein the first current-to-pressure converter is disposed in pneumatic signal transmitting relation to the controllable inlet valve and the second current-to-pressure converter is disposed in pneumatic signal transmitting relation to the controllable depressurizing valve;

pressure regulator means flow connected with the seal air path; and a second source of seal air provided from a tap port disposed at a predetermined location on the compressor discharge.

2. A self-contained seal air and instrument air system comprising;

a multi-stage centrifugal compressor having an inlet, a discharge, and a main rotating shaft which has disposed thereon at least one set of seals, the centrifugal compressor being operable in a loaded and an unloaded condition;

diesel engine means for providing a motive force to the centrifugal compressor;

an inlet valve flow connected with the compressor inlet;

pneumatic means for controlling operation of the inlet valve;

electronic controller means for directing compressor operation;

a receiver tank having an inlet through which compressed air enters and an outlet port which is disposed in a substantially higher location than the location of the inlet;

means for filtering compressed air flowing from the receiver tank through the outlet port;

means for separating the compressed air flowing from the receiver tank into a first path which provides a first source of seal air to the seals of the rotating shaft of the compressor, and a second path which provides instrument air;

valve means for depressurizing the compressed air system;

pneumatic means for controlling operation of the depressurizing valve means;

means for filtering and drying the compressed air entering the instrument air path;

means for separating the compressed air flowing in the instrument air path into a first path which provides actuating air to the means for controlling operation of the inlet valve and the means for controlling operation of the depressurizing valve means, and a second path which provides a source of signal air;

pressure regulator means flow connected with the actuator air path;

filter regulator means for filtering the air entering the signal air path and for regulating the pressure in the signal air path to a predetermined pressure;

first and second current-to-pressure converter means flow connected in the signal air path and disposed in signal receiving relation to the electronic controller which is operable to supply the first and second current-to-pressure converter means with a predetermined current signal, and wherein the first current-to-pressure converter is disposed in pneumatic signal transmitting relation to the pneumatic means for controlling operation of the inlet valve, and the second current-to-pressure converter is disposed in pneumatic signal transmitting relation to the pneumatic means for controlling operation of the depressurizing valve means, the first and second current-to-pressure converters providing a pneumatic signal which is linear with respect to the current signal;

pressure regulator means flow connected with the seal air path; and a second source of seal air provided from a tap port which is flow connected at the first stage outlet of the compressor, and wherein during compressor operation, if the receiver tank pressure is equal to or greater than the pressure at the tap port, the receiver tank will supply seal air to the seal air branch, and if the receiver tank pressure is less then tap port pressure, the compressed air from the tap port will supply the seal air.

3. A self-contained seal air and instrument air system, as claimed in claim 2, which further includes a normally closed pressure switch which is disposed in electronic communication with the electronic controller, and which is mounted in pressure sensing relation with the seal air path pressure regulator means, the pressure switch providing automatic shutdown of the compressor when the pressure of the compressed air flowing from the pressure regulator is less than a predetermined value.

4. In a compressed air system having a centrifugal compressor which includes at least one stage, a compressor inlet, a compressor discharge, and a main rotating shaft which has disposed thereon at least one set of seals, the centrifugal compressor being operable in a loaded and an unloaded condition, a method of providing seal air to the compressor shaft seals, the method comprising:

storing compressed air in a receiver tank having an inlet through which the compressed air enters and an outlet port through which the compressed air may pass at a predetermined time;

filtering the compressed air flowing from the receiver tank through the outlet port;

transmitting, as a first source of seal air to the seals of the rotating shaft of the compressor, the compressed air flowing from the outlet port of the receiver tank to a pressure regulating means;

regulating the first source of seal air to a predetermined pressure;

bleeding compressed air from a first stage of the centrifugal compressor;

transmitting, as a second source of seal air to the seals of the rotating shaft of the compressor, the compressed air flowing from the first stage of the centrifugal compressor to the pressure regulating means; and regulating the second source of seal air to a predetermined pressure, and during compressor operation, if the receiver tank pressure is equal to or greater than the pressure at the first stage of the centrifugal compressor, transmitting the first source of seal air to the seals of the rotating shaft of the compressor, and if the receiver tank pressure is less than the pressure at the first compressor stage transmitting the second source of seal air to the seals of the rotating shaft of the compressor.

* * * * *